United States Patent [19]

Krug et al.

[11] 4,259,749

[45] Apr. 7, 1981

[54] FOLD-OVER LACE BAND FOR INTIMATE APPAREL GARMENTS

[75] Inventors: Herbert A. Krug, Northvale, N.J.; Gerald Gluckin, New York, N.Y.

[73] Assignee: Liberty Fabrics of NY, Inc., New York, N.Y.

[21] Appl. No.: 42,636

[22] Filed: May 25, 1979

[51] Int. Cl.[3] ..... A41D 27/08

[52] U.S. Cl. ..... 2/244

[58] Field of Search ..... 66/176, 195; 28/164; 2/244, 274; 128/425

[56] References Cited

U.S. PATENT DOCUMENTS

| | | | |
|---|---|---|---|
| 1,559,505 | 10/1925 | Gurrie | 66/172 R |
| 1,784,548 | 12/1930 | Seidman | 2/274 |
| 2,783,631 | 3/1957 | Sumner | 66/177 |
| 3,382,505 | 5/1968 | Walser | 66/172 R |

FOREIGN PATENT DOCUMENTS

| | | | |
|---|---|---|---|
| 22142 | of 1908 | United Kingdom | 2/244 |
| 1376757 | 10/1974 | France | 2/274 |

*Primary Examiner*—Doris L. Troutman

*Attorney, Agent, or Firm*—Kenyon & Kenyon

[57] ABSTRACT

This invention concerns a knitted elastic fold-over edge band for use as edging for example on women's undergarments wherein the edge band would be folded lengthwise and sewn to the edge of the item of apparel, such as a brassiere, panty, etc. Half of the width of the edge band would have a soft surface created by knitting half the band width with a jersey stitch using textured yarn while the other half of the band width would be made with conventional lace construction. The soft half of the band would be adjacent the wearer's skin, thereby providing comfort, while the lace portion would be exposed on the outer surface of the item of apparel, thereby providing a decorative element. The edge band would be sewn to the garment in this manner and beauty would be enhanced since the stitches used for sewing the edge band would be less visible since they would be disguised by the lace design.

6 Claims, 3 Drawing Figures

FOLD-OVER LACE BAND FOR INTIMATE APPAREL GARMENTS

BACKGROUND OF THE INVENTION

Edge bands have been used in the past in regard to various items of apparel, such as women's undergarments. Typically, the edge band would be sewn to the edge of the garment with one-half of the band being between the garment and the wearer's skin and the other half of the band being exposed and lying on the outer surface of the garment.

In items of feminine intimate apparel, such as brassieres, two elements are of importance, comfort and beauty, with these two elements not being necessarily compatible. For example, lace provides a pleasing element of decoration to the garment but yet lace has inherently a relatively rough surface caused by the intricacy of the design pattern. A fold-over edge band constructed entirely of lace, while it would possess a decorative element, would be quite uncomfortable as the raised lace pattern would tend to chafe against the wearer's skin and cause irritation and marking of the skin. Conventional knitting can create a textile surface which is of more comfort when placed in contact with the wearer's skin; however, conventional knitting produces textiles which would be relatively uninteresting and austere to the observer and would entail a connotation of pure functionality which would not necessarily be in keeping with the tastes of the wearer.

Fold-over bands have been made in the past with a woven construction, with limited design possibilities. Lip elastics have been used as a fold-over edge but without the soft face and unique properties of the present invention.

BRIEF SUMMARY OF THE INVENTION

In accordance with this invention, a knitted fold-over edge band is provided which has along one half of its width a soft surface and along the other half of its width a lace design. The fold-over edge band, which can be made on a conventional Raschel machine, would have half of its width made by knitting with a conventional stitch, such as a jersey stitch, using textured yarn. The other half of the band width would be made using conventional Raschel or Tricot lace construction. The smooth knitted textured yarn surface would then be placed along the inner surface of the garment with the lace surface lying along the outer surface of the garment and the edge band would be sewn into place. The lace outer surface would provide an element of decoration while the smooth knitted inner surface would provide comfort to the wearer. In addition, the lace surface would disguise the existence of the stitches used to sew the edge band to the garment and would provide an additional element of beauty in that the stitches would not detract from the appearance of the finished garment. The fold-over edge band can include conventional elastic yarns which would provide for an elastic property in the edge band.

DETAILED DESCRIPTION

Figure 1:
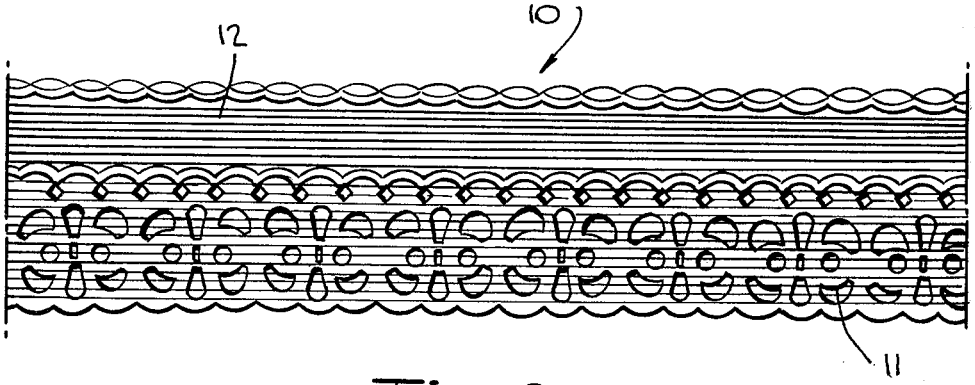
FIG. 1 is a plan view of an edge band constructed in accordance with the principles of the present invention.

Referring now to the drawings, FIG. 1 shows an elastic fold-over edge band designated generally by reference numeral 10, half the width of which has a conventional lace design portion 11 with the other half having a relatively soft jersey portion. The band can be made in any conventional manner and, according to a preferred embodiment, is made on a Raschel lace machine. The fold-over soft surface 12 is made by knitting half the band using any appropriate knit stitch such as, for example, the jersey stitch shown and is preferably made using textured yarn in order to increase softness.

If desired, the band can be given an elastic property by using an appropriate elastic yarn (not shown) in the band's base structure; an appropriate elastic yarn would be, for example, Spandex yarn.

Figure 2:
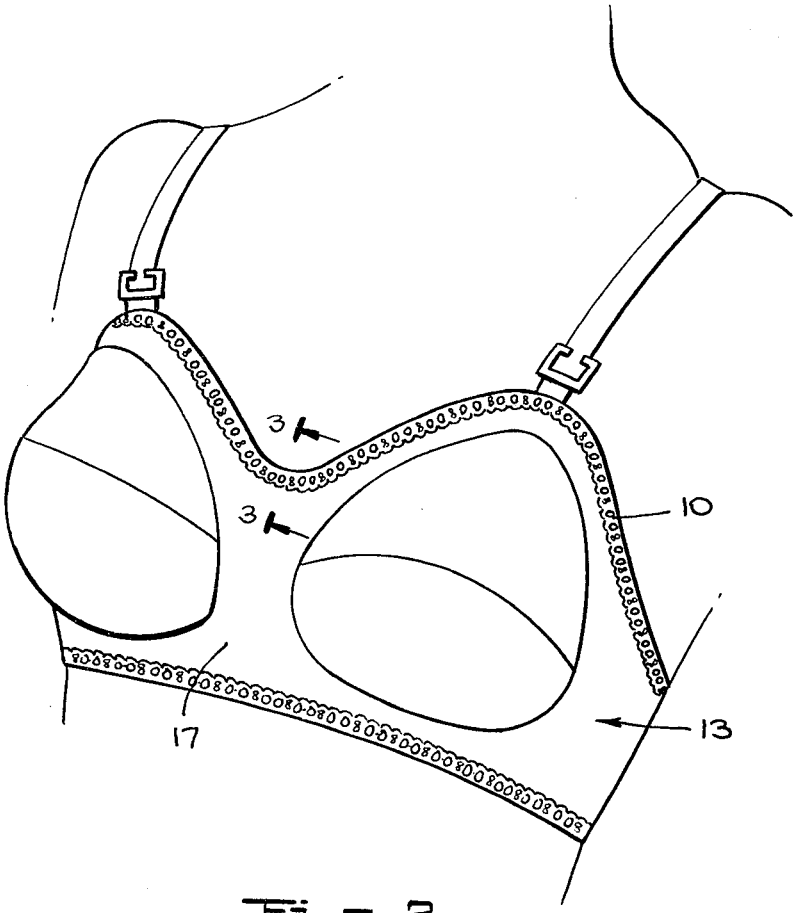
FIG. 2 is a reduced perspective view of a brassiere incorporating the edge band of FIG. 1.
Figure 3:
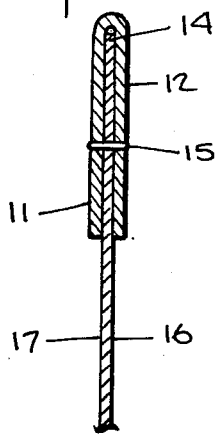
FIG. 3 is a partial section taken along lines 3—3 of FIG. 2.

The band, which can be made in various widths for use on different parts of a garment 13 would be folded lengthwise, as shown in FIGS. 2 and 3, enveloping the garment edge or border 14 and would be sewn to the edge of the garment by any conventional means such as thread or yarn 15.

The fold-over band 10 according to the invention is particularly appropriate for use in women's undergarments. The band would be folded lengthwise along the border of, for example, a brassiere 13 with the soft knitted portion being arranged on the inner surface 16 of the garment so that only the soft portion 12 comes into contact with the skin (not shown) while the lace portion 11 would lie on the outer surface 17 of the garment providing a desirable decorative effect without the concurrent discomfort which would normally be attendant to the use of a lace border due to the inherent rough surface of a lace pattern.

The beauty of the band according to the invention is further enhanced in that, when the band is sewn to the edge of the garment, the stitches which will pass through the visible lace surface will be automatically hidden in the complex decorative stitching of the lace material. That is, since the lace outer surface is inherently decoratively elaborate, the stitching used to affix the fold-over band to the edge of the garment will be lost visually in the lace decorative pattern, thereby increasing the beauty of the fold-over band.

As mentioned, the fold-over band includes a visible lace portion and a soft portion which will contact the skin of the wearer. The soft portion is preferably a jersey stitch and could be made in terms of the Raschel notation as follows: Bar 1 would knit a ground 2-0, 0-2 chain stitch, Raschel notation, using a yarn which would be compatible with the yarns used in the lace design portion of the band. Bar 2 would be threaded with yarn capable of creating a soft, pleasing to the touch surface on that part of the band which would lie next to the skin such as a textured yarn of nylon or polyester. Bar 2 would be actuated to inlay the soft textured yarn into the chain stitch ground being knit by bar 1. A well-known way to inlay the yarn would be to apply a lateral motion to the bar with the use of a 0-0, 4-4, chain link reading. Optionally, bar 2 could be actuated to make a knitted stitch such as 2-0, 2-4, Raschel notation, which would create an appropriate soft face for that part of the band which would be next to the skin when the band is applied to the garment. A soft yarn should be used and the knitting should be performed with minimum tension so as to enhance the softness of the band. The lace portion of the band would be created by use of conventional lace techniques. The Raschel machine and notation is, of course, well known in the art. See, for example, *Man-Made Textile Encyclopedia,* copyright 1959, Library of Congress, Catalog Card No. 59-15700. Textile Book Publishers, Division of Interscience Publishers, Inc., New York, pages 467–472. The knitting of laces on the Raschel machines is described on page 470.

The band can be made of any desired width, for example, one-half inch which would have a lace design portion one-quarter inch wide and a soft fabric portion one-quarter inch wide.

The lengthwise folding of the band can be made easier by connecting the lace portion and the soft fabric portion with the low denier count of yarn, such as 20 denier nylon monofilm yarn and by keeping the connections between the two halves to a minimum.

A picot effect can be created by connecting the two halves of the band with yarn of appropriate size and with the connection between the two halves spaced for the picot effect.

As can be seen from the above description, the fold-over band of the present invention provides a structure that may be made in various widths for use on different parts of a garment such as women's intimate apparel (panties, brassieres, girdles, etc.) and having the following desirable properties:

1. more economical assembly of the garment,
2. less bulky seams,
3. soft against the body—greater comfort,
4. knitted decorative lace as opposed to woven material,
5. sewing stitches are camouflaged by the lace to give more attractive appearance.

While one embodiment is shown and described herein, it is to be understood that changes and additions may be made by those skilled in the art without departing from the scope and spirit of the invention.

What is claimed is:

1. A fold-over edge band for garments including:

(a) a decorative edge lace portion, (b) a relatively soft knitted portion which is substantially non-chafing and non-irritating to the human skin, and (c) the lace and soft knitted portion being provided along the length of the edge band adjacent to each other and connected to each other by a material having a relatively low denier count.

2. In a garment adapted to be worn adjacent to the skin, a fold-over band including:

(a) a relatively soft knitted portion which is substantially non-chafing and non-irritating to the human skin deposited between the edge of the garment and the wearer's skin, (b) a relatively decorative lace portion located on the outer surface of the garment, the edge of the garment being between the soft portion and the lace portion, and (c) means for affixing the edge band to the edge of the garment such that said band is not readily detachable from said garment, and such that said means is substantially hidden by said decorative portion.

3. A fold-over edge band in accordance with claim 2 wherein the relatively soft knitted portion is knitted with a jersey stitch.

4. A fold-over edge band in accordance with claim 2 wherein the lace portion and the knitted portion are connected by material having a relatively low denier count.

5. A fold-over edge band in accordance with claim 2 wherein the lace portion and the knitted portion include elastic yarn components.

6. A fold-over edge band in accordance with claim 2 wherein the means for affixing is a sewn connection.

* * * * *